US009591939B2

(12) United States Patent
Rothenberg

(10) Patent No.: US 9,591,939 B2
(45) Date of Patent: Mar. 14, 2017

(54) PALM BRANCH HOLDER

(71) Applicant: Yosef Rothenberg, Lakewood, NJ (US)

(72) Inventor: Yosef Rothenberg, Lakewood, NJ (US)

( * ) Notice: Subject to any disclaimer, the term of this patent is extended or adjusted under 35 U.S.C. 154(b) by 0 days.

(21) Appl. No.: 14/710,079

(22) Filed: May 12, 2015

(65) Prior Publication Data

US 2015/0342384 A1 Dec. 3, 2015

Related U.S. Application Data

(60) Provisional application No. 61/991,772, filed on May 12, 2014.

(51) Int. Cl.

| | |
|---|---|
| ***A47G 33/00*** | (2006.01) |
| *A47G 33/12* | (2006.01) |
| *E04H 12/22* | (2006.01) |

(52) U.S. Cl.

CPC ..... *A47G 33/00* (2013.01); *A47G 33/12* (2013.01); *E04H 12/2238* (2013.01)

(58) Field of Classification Search

CPC ..... A47G 33/00; F16M 11/04; F16M 11/38
USPC ..... 248/166, 167, 170, 171, 436, 519, 528, 248/533

See application file for complete search history.

(56) References Cited

U.S. PATENT DOCUMENTS 2,723,482 A * 11/1955 Marten ..... A01K 97/08 206/315.11
3,772,819 A * 11/1973 Ratzlaff ..... A01K 97/08 43/26
4,222,193 A * 9/1980 Beck ..... A01K 97/08 206/315.11
4,530,178 A * 7/1985 Rauscher ..... F41C 33/06 43/26
4,695,022 A * 9/1987 Mendonsa ..... F16M 11/38 206/314
5,340,068 A * 8/1994 Sarkisian ..... E01F 9/012 248/170
6,007,032 A * 12/1999 Kuo ..... F16M 11/10 248/125.1
6,056,250 A * 5/2000 Hillstrom ..... E01F 9/012 248/127
6,283,421 B1 * 9/2001 Eason ..... G10G 5/00 248/170
6,305,653 B1 * 10/2001 Oldham ..... F16M 11/00 248/125.8
6,315,251 B1 * 11/2001 Stoudt ..... E01F 9/012 248/156
6,487,807 B1 * 12/2002 Kopman ..... F41A 23/12 42/72
D469,278 S * 1/2003 Lippert ..... D17/13
D469,630 S * 2/2003 Lippert ..... D17/13
(Continued)

FOREIGN PATENT DOCUMENTS

IL WO 2014045285 A1 * 3/2014 ..... A47G 33/00

*Primary Examiner* — Rodney Mintz
(74) *Attorney, Agent, or Firm* — Amster, Rothstein & Ebenstein LLP

(57) ABSTRACT

A tabletop stand for holding a palm branch in an upright orientation. The stand has a horizontal sleeve which is a receptacle for a bottom aspect of a palm branch. The sleeve is provided with a slot so that the stand may be used in combination with an elongated plastic bag which has a rod extending for a segment of the bag's length. A bottom segment of the rod and surrounding bag is inserted into the sleeve and a lateral part of the bag passes through the slot.

1 Claim, 5 Drawing Sheets

(56) References Cited

U.S. PATENT DOCUMENTS

| | | | | |
|---|---|---|---|---|
| 6,604,320 | B1 * | 8/2003 | Hsia | A01G 17/10 211/119.12 |
| 6,685,156 | B2 * | 2/2004 | Dicke | E01F 9/017 248/166 |
| 6,793,191 | B1 * | 9/2004 | Williams | E01F 9/012 248/166 |
| 7,341,234 | B2 * | 3/2008 | Kowalski | A47G 33/1213 248/523 |
| 7,584,568 | B1 * | 9/2009 | Brownlee | F41C 23/16 42/94 |
| 7,669,815 | B2 * | 3/2010 | Clewett | E01F 9/0124 248/163.1 |
| 7,984,884 | B1 * | 7/2011 | Iliev | A47G 33/12 248/146 |
| 8,393,111 | B1 * | 3/2013 | Johnson | A01K 97/10 211/70.8 |
| D693,126 | S * | 11/2013 | Drummey | D3/326 |
| 9,242,764 | B2 * | 1/2016 | Zetterlund | H04R 1/026 206/45.24 |
| 9,282,843 | B1 * | 3/2016 | Al-Anzi | A47G 33/02 434/245 |
| 2005/0218285 | A1 * | 10/2005 | Yorns | B25H 3/006 248/314 |
| 2007/0012851 | A1 * | 1/2007 | Krinner | A47G 33/1213 248/524 |
| 2011/0049309 | A1 * | 3/2011 | Kersting | A01G 5/04 248/27.8 |
| 2012/0312705 | A1 * | 12/2012 | Silam | A47G 33/00 206/216 |
| 2015/0225123 | A1 * | 8/2015 | Zetterlund | H04R 1/026 206/45.24 |

* cited by examiner

PALM BRANCH HOLDER

RELATED APPLICATIONS

This applications claims the benefit of U.S. Provisional Appl. Ser. No. 61/991,772, filed May 12, 2014—the contents of which are incorporated by reference herein.

FIELD OF THE INVENTION

The invention relates to the field of holders, more specifically to a table-top holder for a palm branch.

BACKGROUND OF THE INVENTION

Many people use palm branches (fronds) during the course of religious observance. For example, Jewish people hold palm branches (called a lulav in Hebrew) in their hands during certain religious services. One problem often encountered by such users is the issue of where to store these branches while not being held. Many will lay branches across a table while not in use. However, the branches occupy a lot of linear space and they are susceptible to being knocked off the tabletop or otherwise interfering with other items on the table. There is, therefore, a need in the art for a portable holder for conveniently holding and/or storing palm branches.

SUMMARY OF THE INVENTION

The invention set forth herein is a substantially cylindrical housing which has an inner cavity that is sized and shaped to receive a palm branch. In one embodiment, the inventive holder is configured to hold an elongated plastic bag that is commonly used to transport palm branches. The cylindrical housing is provided with legs or similar structures for supporting the same in an upright position on a tabletop.

DETAILED DESCRIPTION OF THE INVENTION

Embodiments of the present invention will now be described with reference to the above-identified Drawings. However, the Drawings and the description herein of the invention are not intended to limit the scope of the invention. It will be understood that various modifications of the present description of the invention are possible without departing from the spirit of the invention. Also, features described herein may be omitted, additional features may be included, and/or features described herein may be combined in a manner different from the specific combinations recited herein, all without departing from the spirit of the invention.

Figure 1:
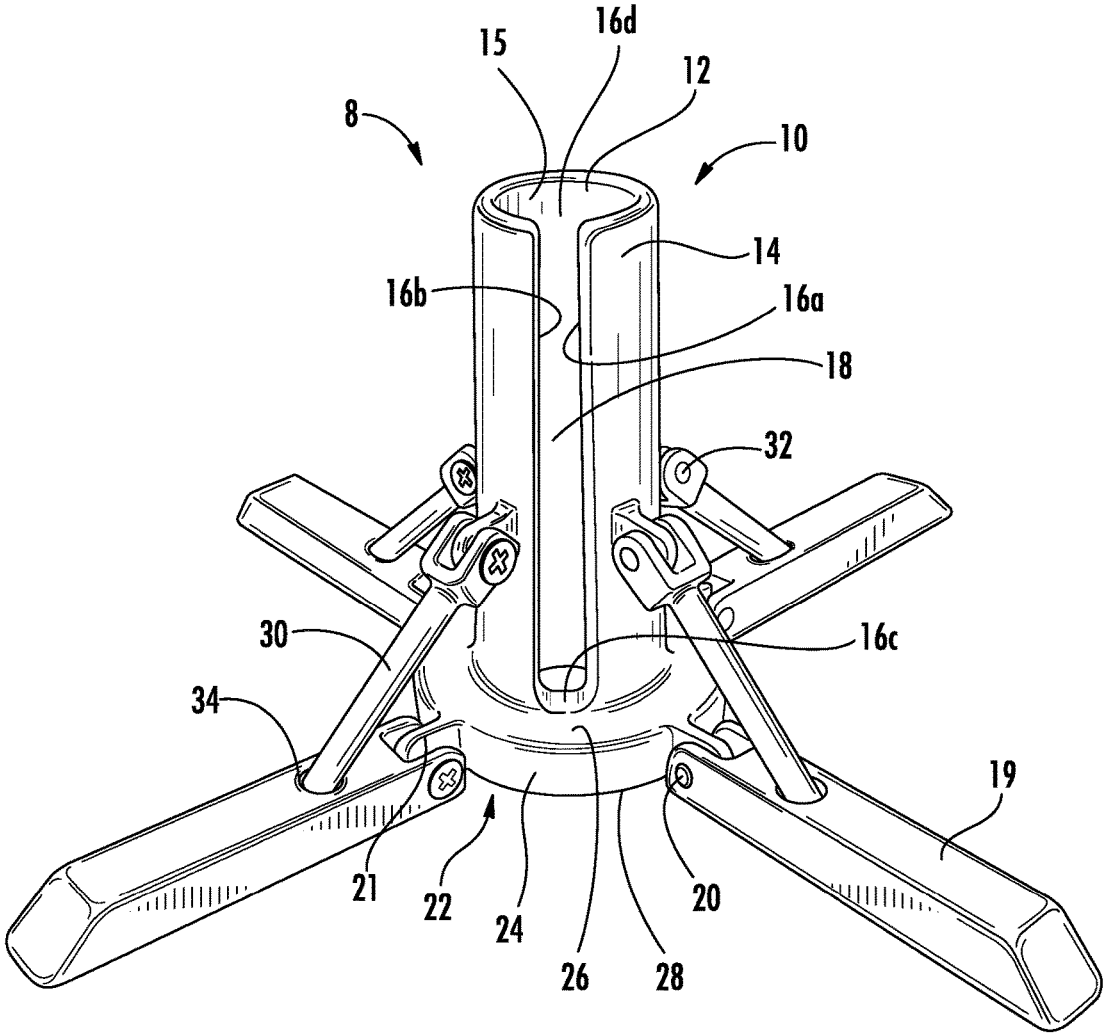
FIG. 1 is a side perspective view of a palm branch holder according to an embodiment of the invention.

FIG. 1 shows a portable branch holder 8 according to an embodiment of the invention. As shown a cylindrical shaped sleeve 10 having an upper opening 12. Sleeve 10 has an outer wall 14 and an inner wall 15. Inner wall 15 defines a cylindrical-shaped cavity that is used to capture a bottom area of a palm branch or a bag for holding a palm branch.

As shown in FIG. 1, a slot 18 is made in the wall 14 of sleeve 10. Slot 18 is a notch out, slot or similar slender longitudinal opening made in wall 14 of sleeve 10. As shown, slot 18 is defined by substantially parallel side walls 16*a*, 16*b*, bottom wall 16*c* and upper opening 16*d*.

In one embodiment of the invention, a plurality of legs extend from the bottom of sleeve 10 which, in use, rest on a table top or similar flat surface. In a preferred embodiment of the invention, legs 19 are attached to sleeve 10 by way of a pivot 20, hinge or similar mechanism which allows for movement of the legs in relation to the sleeve.

In one embodiment, a bottom surface of cylinder 10 is mounted to, or integrally formed with a plinth or similar base member 22. Base 22 has an outer wall 24, a top surface 26 and an underside surface 28. Sleeve 10 is affixed (or integrally formed) orthogonally to upper surface 26 of base 22 and extends upwardly therefrom. As shown in FIG. 1, legs 19 are hingedly mounted to base 22 by way of a pivot 20 passing through a terminal end of leg 19 and through a tab 21 or similar surface projecting from outer wall 24 of base 22.

In a preferred embodiment, support arms 30 are provided for maintaining legs 19 in a deployed position while providing buttressing support for sleeve 10. As shown, support arms 30 have a first end that contacts the outer wall 14 of sleeve 10 and a second end that contacts legs 19. Preferably, support arms 30 are connected to sleeve by way of a hinge, pivot 32 or similar mechanism. In one embodiment, the second end of support arms 30 insert into corresponding notches 34 or similar pockets made in the outer surfaces of legs 19. Notches 34 are sized and shaped to capture terminal ends of support arms 30.

Figure 2:
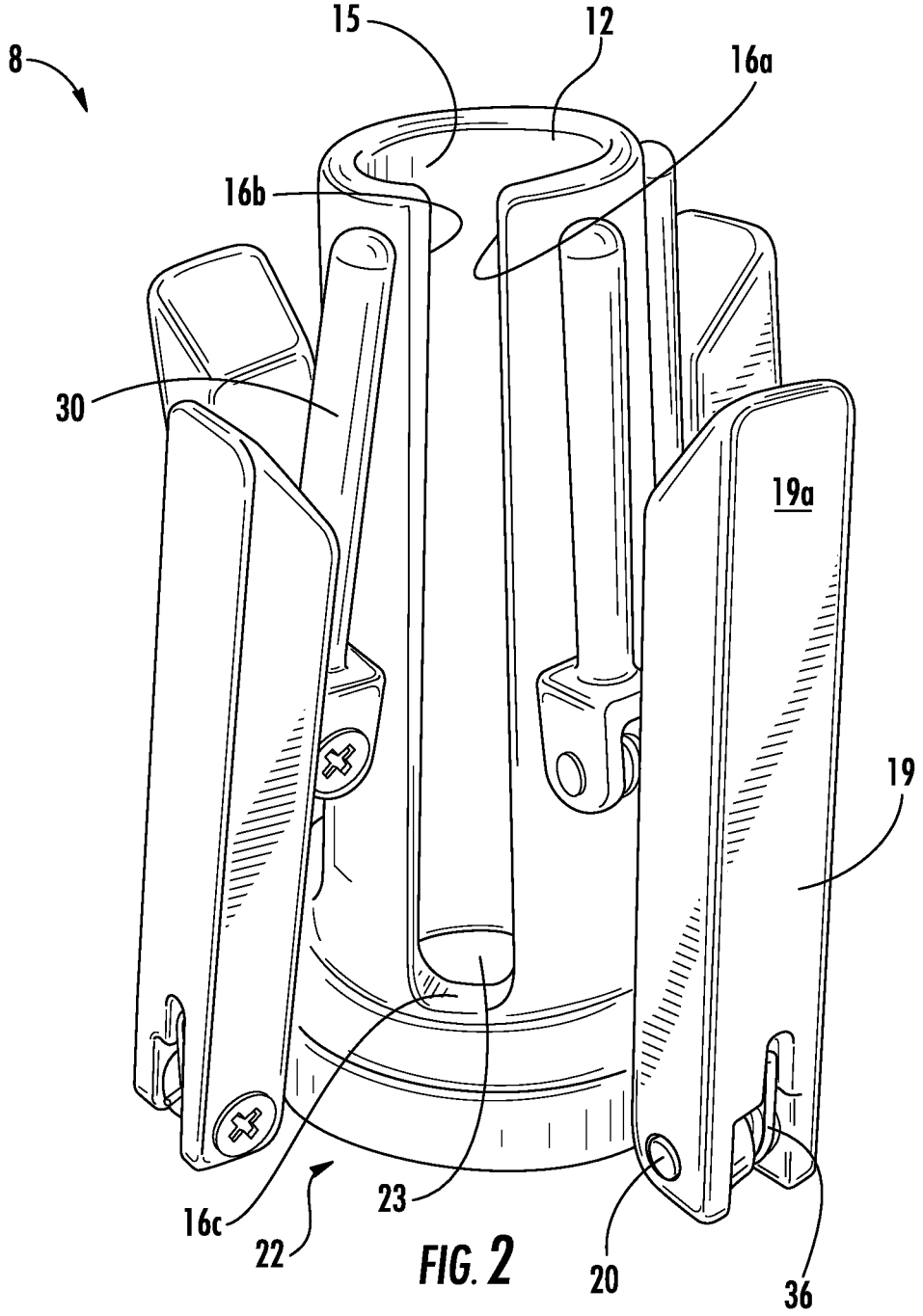
FIG. 2 is a side perspective view of a palm branch holder with its legs folded according to an embodiment of the invention.

FIG. 2 shows a portable palm branch holder 8 with its legs 19 folded upwardly. In an embodiment of the invention, a spring 36 mounted on pivot 20 has an end that contacts the bottom surface 19*a* of leg 19—thus biasing leg upwardly (i.e. to pivot in the direction toward sleeve 10). In storage or non-deployed position, legs 19 are pivoted upwardly to be stowed substantially parallel to outer wall 14 of sleeve 10. Spring 36, maintains legs 19 in such stowed position. Support arms 30 are similarly pivoted upwardly where they are maintained in an upward orientation, substantially parallel to outer wall 14 of sleeve 10. In such storage or non-deployed position, support arms 30 are sandwiched between the outer wall 14 of sleeve 10 and top surfaces of legs 19.

In use, a user rotates legs 19 downward such that they are substantially orthogonal to outer wall 14 of sleeve 10. Support arms 30 are similarly pivoted downward and ends thereof are inserted into notches 34 of legs 19. Support arms 30 provide constant counter bias to springs 36—thereby maintaining legs 19 in a locked position and deployed substantially orthogonally to a longitudinal axis of sleeve 10. Bottom surfaces 19*a* of legs 19 and bottom surface 28 of base 22 are substantially coplanar, forming a bottom plane that is placed in contact with a table top or such similar planar surface.

In the embodiment shown, four legs extend from base 22, but it will be understood that more or fewer than four legs are possible. Moreover, as an alternative to legs 19, base member 22 may be of sufficient width and weight so as to support sleeve 10 in an upright position without the need of extending legs.

In one embodiment of the invention, a bottom segment of a palm branch may be inserted into sleeve 10 through opening 12. The palm branch is thusly supported and maintained in an upright position. However, in another embodiment of the invention, palm branch holder 8 is configured to support a specialized palm branch carry bag.

Figure 3:
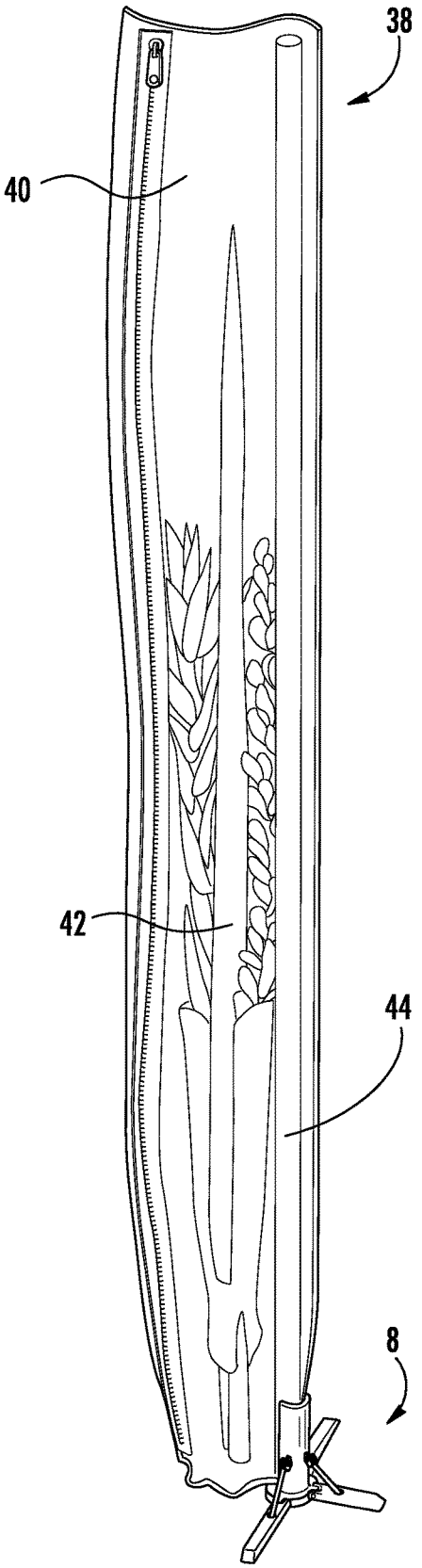
FIG. 3 is a side perspective view of a palm branch holder having an elongated bag secured therein according to an embodiment of the invention.

For example, referring to FIG. 3, a lulav bag is shown. Lulav bag 38 is an elongated plastic bag having plastic walls 40 which create an inner cavity that is sized and shaped to receive a palm branch 42. A rod 44, dowel or similar supporting element is runs along a segment of the interior length of bag 38. Rod 44 is located in a side aspect of the bag 38. Because rod 44 is positioned within the inner confines of bag 38, plastic walls 40 surround, or partially surround rod 44. Rod 44 may be formed of various materials including cardboard, plastic, wood or such similar rigid material.

In an embodiment of the invention, the internal circumference of sleeve 10 is incrementally greater than the external circumference of rod 44. In the embodiment shown, rod 44 (and bag material partially surrounding the same) inserts into sleeve 10 through opening 12. In one embodiment of the invention, the inside walls 15 of sleeve 10 contact bag area surrounding rod 44 and grip the outer bag and rod 44 in a tight frictional grip. In another embodiment of the invention, a bottom surface of bag 38 and rod contact an inner floor surface 23 of sleeve 10, and a bottom bag segment contacts bottom wall 16*c* of slot 18. A segment of bag walls 40 extend laterally out of slot 18. This allows for a branch to be secured inside a bag and maintained in an upright position.

The internal diameter of sleeve 10 is substantially sized and shaped to surround a rod 44 and surrounding plastic bag material. In one preferred embodiment, the internal diameter is between ¾" to 1".

It will be understood by those of ordinary skill in the art that an aspect of the invention is to provide a sleeve, a tube or one or more rounded slots that are sized and shaped to receive outer contours of a rod and surrounding bag material—whereby a segment of the bag may egress laterally through a slot or similar opening.

Figure 4:
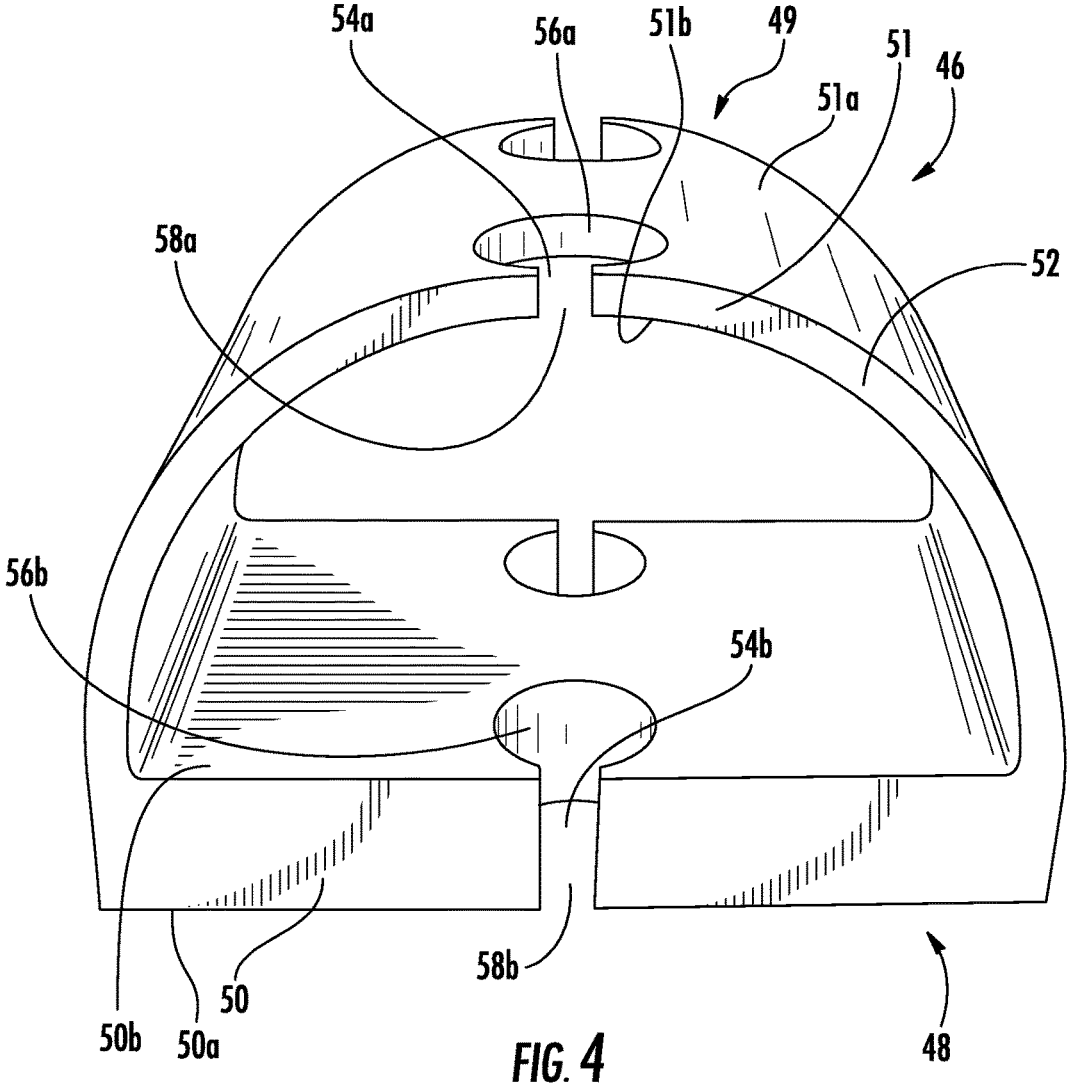
FIG. 4 is a side perspective view of a palm branch holder having two receptacle areas for receiving two elongated palm branch bags according to an embodiment of the invention.

FIG. 4 shows another embodiment of the invention, whereby a dome shaped holder 46 is provide with corresponding upper and lower apertures to receive a rod associated with a lulav bag (or a lower aspect of a palm branch). As shown, holder 46 has a bottom plate 48 and a top plate 49. Bottom plate 48 has a bottom surface 50*a*, a top surface 50*b* and a thickness 50. Top plate 49 also has a top surface 51*a*, a bottom surface 51*b* and a thickness 51. An aspect of top plate is separated in space from bottom plate and is substantially parallel thereto.

A rounded notch out 54*a* or similar aperture is made in top plate 49. Notch 54*a* has an annular wall 56*a* that is substantially the thickness 51 of top plate 49. Annular wall 56*a* is not a complete circle, but rather ends of annular wall terminate in a gap which forms a slot 58*a* in top late 49. Slot 58*a* allows lateral access to notch 54*a*. Similarly, a rounded notch out 54*b* is made in bottom plate 48. Notch 54*b* has an annular wall 56*b* that is substantially the thickness 50 of bottom plate 48. Annular wall 56*b* is not a complete circle, but rather ends of annular wall terminate in a gap, which forms a slot 58*b* in bottom plate 48. Slot 58*b* allows lateral access to notch 54*b*. In the embodiment shown, two respective upper notches and lower notches are shown substantially mirroring one another; however, a single pair of cooperating upper and lower notches or more than two pairs of cooperating upper and lower notches are within the teaching of the invention.

Figure 5:
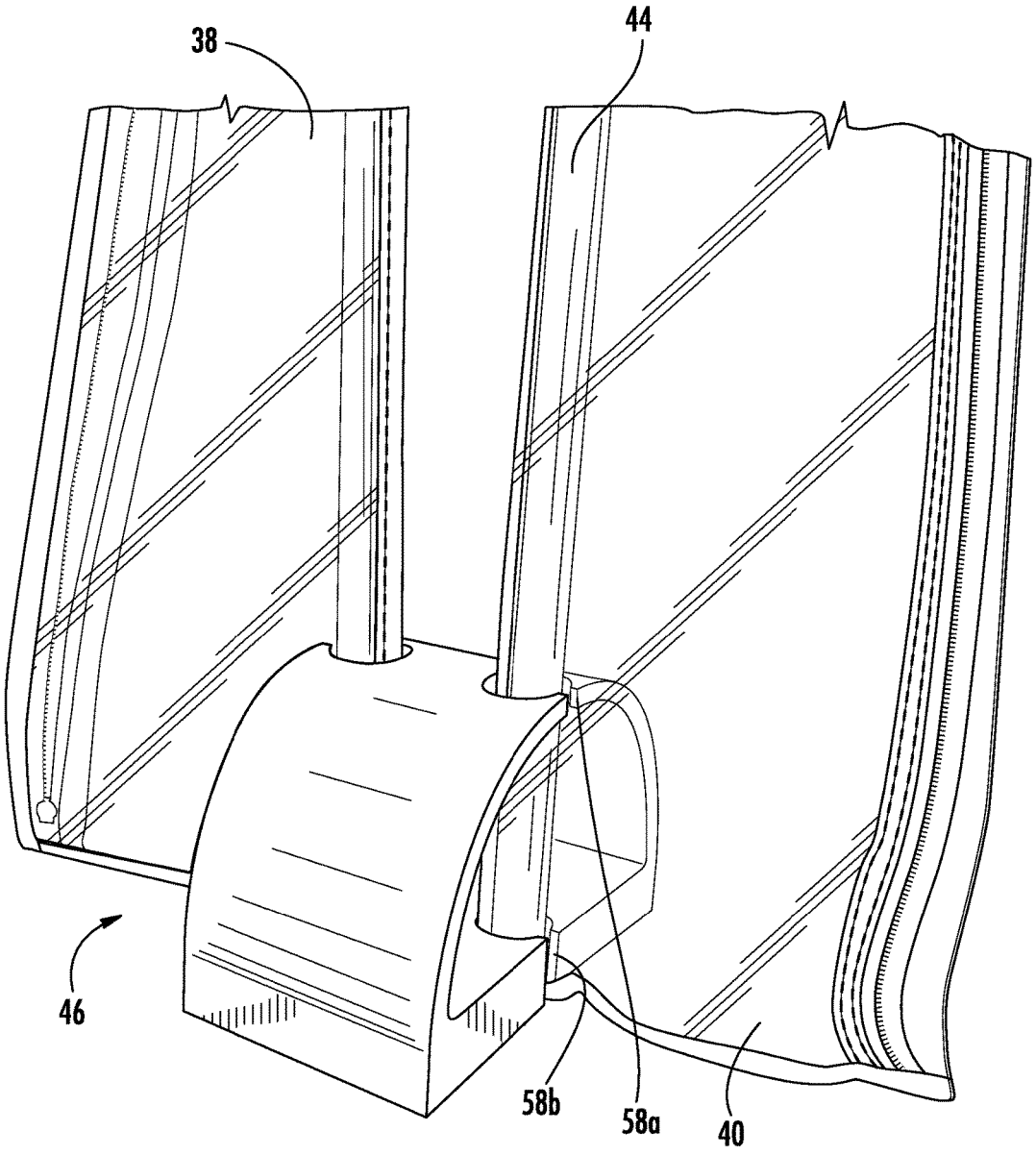
FIG. 5 is a front perspective view of the palm branch holder of FIG. 4 showing palm branch bags in each receptacle according to an embodiment of the invention.

As shown in FIG. 5, a rod 44 of an associated lulav bag 38 is inserted through upper notch 58*a* and into lower notch 58*b*. A bag segment 40 egresses laterally through respective slots 58*a*, 58*b*.

It will be understood by those of ordinary skill in the art that the embodiments shown in FIGS. 4 and 5 are exemplary and that any of various holders having an upper and lower plate or similar support structures having respective notches or similar annular rings in respective upper and lower plates/structures are within the teaching of the invention. The upper and lower notches or annular rings are substantially parallel to one another. In a preferred embodiment, each notch or annular ring has a slot allowing for passage of a bag section.

Having described this invention with regard to specific embodiments, it is to be understood that the description is not meant as a limitation since further modifications and variations may be apparent or may suggest themselves to those skilled in the art. It is intended that the present application cover all such modifications and variations.

What is claimed is:

1. A palm branch holder, comprising:

a sleeve having an outer wall an inner wall, and an inner floor surface;

said sleeve mounted on a base;

a longitudinal slot in the sleeve;

legs extending from said base, the legs having upper surfaces with notches thereon, the legs further comprising springs for biasing the legs toward the sleeve;

pivots for pivotably attaching the legs to the base;

support arms, said support arms having first ends and terminal ends, said support arms pivotably mounted to said outer wall of said sleeve, said support arms inserting into said notches in said upper surfaces of said legs;

an elongated plastic bag the elongated plastic bag having walls and a bottom surface, whereby said elongated plastic bag further comprises a rod located in a side aspect thereof, whereby the elongated plastic bag at least partially surrounds said rod;

the rod inserted into the sleeve whereby the bottom surface of the elongated plastic bag contacts the inner floor surface of the sleeve;

whereby a segment of said walls of the elongated plastic bag passes out of said longitudinal slot.

* * * * *